US011214764B2

(12) United States Patent
Budich

(10) Patent No.: US 11,214,764 B2
(45) Date of Patent: Jan. 4, 2022

(54) CLEANING AND/OR RINSING AGENT MOLDED ARTICLE

(71) Applicant: BUDICH INTERNATIONAL GMBH, Hiddenhausen (DE)

(72) Inventor: Meinrad Budich, Hüllhorst (DE)

(73) Assignee: BUDICH INTERNATIONAL GMBH, Hiddenhausen (DE)

( * ) Notice: Subject to any disclaimer, the term of this patent is extended or adjusted under 35 U.S.C. 154(b) by 267 days.

(21) Appl. No.: 16/304,599

(22) PCT Filed: May 24, 2017

(86) PCT No.: PCT/EP2017/062668

§ 371 (c)(1),
(2) Date: Nov. 26, 2018

(87) PCT Pub. No.: WO2017/202991

PCT Pub. Date: Nov. 30, 2017

(65) Prior Publication Data

US 2019/0292498 A1 Sep. 26, 2019

(30) Foreign Application Priority Data

May 27, 2016 (DE) ..... 10 2016 109 795.0

(51) Int. Cl.
*C11D 17/00* (2006.01)
*C11D 17/04* (2006.01)
(Continued)

(52) U.S. Cl.
CPC ..... *C11D 17/041* (2013.01); *B08B 9/027* (2013.01); *C11D 1/662* (2013.01); *C11D 1/74* (2013.01);
(Continued)

(58) Field of Classification Search
CPC ..... C11D 17/0073; C11D 17/0086; C11D 17/0078; C11D 17/0091
(Continued)

(56) References Cited

U.S. PATENT DOCUMENTS 3,423,322 A * 1/1969 Urfer ..... C11D 3/06 510/446
5,316,688 A 5/1994 Gladfelter et al.
(Continued)

FOREIGN PATENT DOCUMENTS

DE 69203721 T2 1/1996
DE 19800509 A1 7/1999
(Continued)

OTHER PUBLICATIONS

International Search Report and Written Opinion issued by the European Patent Office as the International Searching Authority dated Aug. 2, 2017, which corresponds to International Patent Application No. PCT/EP2017/062668.
(Continued)

*Primary Examiner* — Gregory E Webb
(74) *Attorney, Agent, or Firm* — Studebaker & Brackett PC

(57) ABSTRACT

The present invention relates to a cleaning and/or rinsing agent molded article (1, 1', 1") which is formed as a roller with a roll surface (2) and comprises two end faces (3, 4) connected by the roll surface (2). The cleaning and/or rinsing agent molded article (1, 1', 1") comprises an end face portion (5, 6) on at least one of the two end faces (3, 4), which is designed so that the cleaning and/or rinsing agent molded article (1, 1', 1") falls sideways onto the roll surface (2) when the cleaning and/or rinsing agent molded article (1, 1', 1") meets the relevant end faces (3, 4) or is placed against a solid surface. A cleaning product comprises a pouch, in
(Continued)

which a cleaning and/or rinsing agent molded article of this type is located. A cleaning product (10) is also described, comprising a sealed pouch (11) in which a cleaning and/or rinsing agent molded article (1, 1', 1") of this type is located. Also described is the use of a cleaning and/or rinsing molded article (1, 1', 1") of this type for cleaning the interior of an appliance and a method for cleaning the interior of an appliance, more particularly an industrial cooking appliance (100) using the cleaning and/or rinsing agent molded article (1, 1', 1"). Finally described are a method and a device for the production of a cleaning and/or rinsing agent molded article (1, 1', 1") of this type.

7 Claims, 7 Drawing Sheets

(51) Int. Cl.

| | |
|---|---|
| ***B08B 9/027*** | (2006.01) |
| ***C11D 1/66*** | (2006.01) |
| ***C11D 1/74*** | (2006.01) |
| ***C11D 3/04*** | (2006.01) |
| ***C11D 3/08*** | (2006.01) |
| ***C11D 11/00*** | (2006.01) |
| ***F24C 14/00*** | (2006.01) |

(52) U.S. Cl.
CPC ..... *C11D 3/044* (2013.01); *C11D 3/046* (2013.01); *C11D 3/08* (2013.01); *C11D 11/0023* (2013.01); *C11D 17/0073* (2013.01); *F24C 14/005* (2013.01)

(58) Field of Classification Search
USPC ..... 510/446, 445
See application file for complete search history.

(56) References Cited

U.S. PATENT DOCUMENTS

| | | | | |
|---|---|---|---|---|
| 6,172,020 | B1 | 1/2001 | Binstock et al. | |
| 6,306,814 | B1 * | 10/2001 | Appel | C11D 17/0078 510/224 |
| 6,610,643 | B1 * | 8/2003 | Von Bezold | B65D 75/46 510/224 |
| 2002/0006890 | A1 * | 1/2002 | Sunder | C11D 17/041 510/446 |
| 2007/0009561 | A1 * | 1/2007 | Holderbaum | C11D 17/0073 424/401 |
| 2008/0274941 | A1 * | 11/2008 | Barthel | C11D 17/042 510/445 |
| 2008/0286344 | A1 * | 11/2008 | Darmuzey | A61P 9/00 424/443 |
| 2015/0191679 | A1 | 7/2015 | Moore | |
| 2018/0105775 | A1 * | 4/2018 | Fox | C11D 9/26 |
| 2019/0216966 | A1 * | 7/2019 | Mancini | A61L 9/012 |

FOREIGN PATENT DOCUMENTS

| | | | |
|---|---|---|---|
| DE | 10111780 | A1 | 10/2002 |
| DE | 202011000329 | U1 | 1/2012 |
| DE | 102013113298 | A1 | 6/2015 |
| EP | 1600497 | A1 | 11/2005 |
| WO | 01/36290 | A1 | 5/2001 |
| WO | 03/073002 | A1 | 9/2003 |

OTHER PUBLICATIONS

German Search Report issued by the European Patent Office dated Nov. 2, 2016, which corresponds to European Patent Application No. 10 2016 109 795.0.

* cited by examiner

CLEANING AND/OR RINSING AGENT MOLDED ARTICLE

The present invention relates to a cleaning and/or rinsing agent molded article as well as to a cleaning product comprising a pouch, in which a cleaning and/or rinsing agent molded article of this type is located. The invention furthermore relates to a use of a cleaning and/or rinsing agent molded article of this type, in particular of the cleaning product for cleaning the interior of an appliance, in particular of a commercial cooking appliance, as well as a method for cleaning the interior of a commercial cooking appliance using the cleaning and/or rinsing agent molded article. Finally, the invention relates to a method and to a device for the production of a cleaning and/or rinsing agent molded article of this type.

Cleaning and/or rinsing agent molded articles are known in a large variety of forms, for example as, mostly flatter, cylindrical or square tabs. There are furthermore tabs, which have additional elements, such as balls embedded in the surface of the tab, etc. Such tabs typically serve to simply metering a cleaning agent and/or rinsing agent, wherein the different elements or different layers of the tab, respectively, have different effects and dissolve at different temperatures. In addition, there are tabs, which only include cleaning agents, and tabs, which only contain rinsing agents. In contrast to powders, all of these cleaning and/or rinsing agent molded articles (hereinafter also referred to in short as "molded articles") offer the advantage of an accurate and simple metering, they do not raise dust and can be handled easily. These advantages can be used to clean dishes for example in household dishwashers or in commercial dishwashers.

A further possible point of use would be the cleaning of the interior of the appliance itself (thus not while washing the dishes). Such a cleaning of an interior is also required in other commercial appliances in the gastronomy and/or food production sector, for example in commercial cooking appliances. A commercial cooking appliance is hereby understood to be an appliance, which typically serves for the commercial use, for example in commercial kitchens, restaurants and bakeries, points of sale, etc., for the thermal preparation (cooking) and/or heating of food. This includes in particular boiling appliances, grilling appliances, ovens, automatic baking machines, steam cookers, combination steamers, microwave ovens or deep-fryers. A periodic internal cleaning of the commercial cooking appliance, in particular the cooking chamber thereof, in which the dishes are typically prepared, should in particular take place here. A specific problem exists in particular in the case of cooking appliances, which operate with water and/or water vapor, such as for example steam cookers or combination steamers. On principle, such appliances have a line system comprising chambers, valves, pumps, etc., to supply water and/or water vapor to the cooking chamber or to guide the water and/or the vapor in a recirculation circuit formed by the line system, respectively. This line system does not have access to a manual cleaning, but needs to nonetheless be kept hygienically clean.

To ensure the necessary hygiene, it is advantageous to use highly alkaline cleaning agents to clean commercial appliances in the gastronomy and/or food production sector, in particular commercial cooking appliances. When using highly alkaline, corrosive cleaners in the form of powder or granules, respectively, or as liquid, there is the risk that the cleaner is spilled or splashes and thus results in skin or eye contact with the user. When metering such highly alkaline cleaners, the user thus needs to at least wear gloves and safety glasses.

In the meantime, there are thus commercial cooking appliances, into which holders are installed, into which bottles can in turn be hooked, which contain a certain metered quantity of cleaner, which then dissolves during the cleaning process. Here, the user does not have any contact with the cleaning agent itself.

When using cleaners in the form of tablets or molded articles, respectively, they are typically positioned in a specific metering drawer, which is connected to the cleaning cycle. On principle, it would also be possible to place the tablet in the cooking chamber. A cleaning program is then started, in response to which water and/or water vapor is supplied, wherein the tablet dissolves. A simple placement of the tablet at an undefined position on the bottom of the cooking chamber, however, could have the result that the tablets dissolve differently as a function of the respective position, i.e. that the desired effect is not attained in the same way in the case of each cleaning process. The tablets should thus always be positioned at a defined location, i.e. in the vicinity of a water/steam inlet (which is located in a side wall of the cooking chamber in the case of many appliances, e.g. in a fan propeller). However, for an accurate positioning at a defined position, the user needs to once again wear gloves, because he should not touch the tablets with the skin.

It is thus an object of the present invention to create an alternative for the above-described variations for cleaning the interior of an appliance, in particular of a commercial cooking appliance, in the case of which a defined positioning of the cleaning and/or rinsing agent molded article is possible in the interior of the appliance, without the user unintentionally coming into contact with the cleaning agent.

This object is solved by means of a cleaning and/or rinsing agent molded article, a cleaning product, a use of the cleaning and/or rinsing agent molded article according to the invention, a method for cleaning a commercial cooking appliance, as well as a method and a device for the production of a cleaning and/or rinsing agent molded article of this type.

A cleaning and/or rinsing agent molded article according to the invention is formed as roller with a roll surface and has two end faces, which are connected by the roll surface and which are arranged transversely to a longitudinal axis of the molded article. For example, this roller can be designed so as to be elongated, in a roller-like manner, comprising a roll surface, which extends along the longitudinal axis of the roller. The base body of this roller can thereby preferably be formed as elongated cylinder, wherein the cylinder jacket surface forms the roll surface.

According to the invention, the cleaning and/or rinsing agent molded article has, on at least one of the two end faces, a tip-like or tapering end face portion, respectively, which is designed so that the cleaning and/or rinsing agent molded article falls onto the roll surface, when it meets the relevant end face or is placed against a sufficiently solid surface, i.e. the end face portion. This means that the formation of the end face portion for example as tip, if applicable also round tip, ensures that the roller does not stop on this end face, but essentially always falls sideways onto the roll surface, unless other forces act or obstacles are in the way. It can then roll off across this roll surface on an inclined plane. The falling sideways onto the roll surface can thereby also be supported in that the cleaning and/or rinsing agent molded article is formed accordingly with respect to weight or density, respectively, e.g. has a higher density in the region of the roller-like or cylindrical base body, respectively (with the roll surface) than in the region of the end face portion.

Due to the specific formation of the cleaning and/or rinsing agent molded article according to the invention, it can be utilized that the interiors of almost all machines, which are to be cleaned, in particular of commercial cooking appliances, have a slightly funnel-like bottom surface comprising an outlet nozzle at the lowest point. This bottom construction is required, because the water is to drain securely into the outlet after a utilization process or cleaning process, respectively, and puddles do not form in the bottom region. Regardless of where exactly the outlet nozzle is located on the bottom and whether it can be accessed easily by the user, it is possible as a result of the specific form of the cleaning and/or rinsing agent molded article to always position the latter at an exactly defined location without large effort, namely at the outlet or on/in an outlet screen of the outlet, respectively. For this purpose, it is only necessary that the user places the cleaning and/or rinsing agent molded article at any location of the bottom or drops it. The cleaning and/or rinsing agent molded article then falls sideways onto its roll surface and rolls on the inclined place of the bottom surface to the outlet. The agents inside the cleaning and/or rinsing agent molded article and the dosage or agent quantity, respectively, can thus be set in such a way that an optimal result is achieved when the cleaning and/or rinsing agent molded article is positioned in the outlet or on/in an out outlet screen, respectively, on the bottom of the appliance or of the commercial cooking appliance, respectively.

On principle, this would also be possible with a ball, but the production of balls is significantly more extensive, provided that a safe roll is to be ensured, because two ball halves are normally divided in a pressing process by an edge or a bead, respectively, on which the ball can come to a halt on an only slightly inclined surface and then does not reach the outlet.

Particularly preferably, the cleaning and/or rinsing agent molded article has a tapering end face of this type only on an end face and it can for example have a simple flat end face or the like on the other side. A cartridge form or suppository form of this type looks particularly appealing and can have production technology-related advantages, depending on the type of production.

A preferred cleaning product according to the invention comprises a sealed pouch, in which a cleaning and/or rinsing agent molded article of this type is located. The pouch is thereby preferably formed in a tube-like manner and has a tear element, which is arranged and designed so that the cleaning and/or rinsing agent molded article can be moved out of the pouch, end face portion first, after tearing open the pouch as intended by means of the tear element, for example by the force of gravity and/or by pushing the molded article out of the pouch. For this purpose, the tear element is for example arranged and formed on the pouch so that the pouch can only be torn open on one side, where the tapering end face portion is located, so that it is only possible to automatically convey the molded article out of the pouch, the end face portion first. For example, this can be a tear notch, which is arranged either on a narrow side, i.e. on the corresponding end face of the pouch, or on an upper edge close to this narrow side on a longitudinal side of the pouch. An example for this will be shown later by means of the figures. Instead of or in addition to such a tear notch, a tear tab or similar elements can be used as well.

As already mentioned, a use according to the invention of such a cleaning and/or rinsing agent molded article takes place in the course of the cleaning of an interior of an appliance in the gastronomy and/or food production sector, in particular of a commercial cooking appliance, preferably of a commercial boiling appliance, of a grilling appliance, of an oven, of an automatic baking machine, of a steam cooker, of a combination steamer, of a microwave oven or of a deep-fryer, wherein the interior of a commercial cooking appliance is the cooking chamber thereof.

In the case of a method according to the invention for cleaning an interior of an appliance, preferably of a commercial cooking appliance, the following steps are carried out accordingly:

A cleaning and/or rinsing agent molded article according to the invention, which preferably comprises highly alkaline cleaning agents, is introduced end face portion first onto a bottom of the interior, preferably of a cooking chamber of the commercial cooking appliance. As described above, this cleaning and/or rinsing agent molded article automatically falls onto is roll surface and then rolls across the slightly inclined surface of the bottom to the outlet, if applicable in front of an outlet screen.

The cleaning and/or rinsing agent molded article, which is preferably pressed from a pressed material with the highly alkaline cleaning agent, is then dissolved by adding solvent, in particular water, to create a liquefied cleaning agent or cleaning concentrate, respectively, of rinsing agent concentrate. For a good tableting capacity, the raw materials or the pressed material, respectively, are selected in such a way or are sifted or granulated, respectively, ahead of time, if necessary, so that a grain size distribution is preferably at hand, in the case of which more than 50%, particularly preferably more than 75%, most preferably more than 90% lie within the grain size range of approximately 200 μm to 1600 μm.

Particularly preferably, the solvent is warm water, which was heated to a corresponding temperature, which is required for the successful cleaning process and at which the cleaning and/or rinsing agent molded article dissolves in the desired manner, for example water at a of above approximately 30° C., preferably above approximately 40° C., in particular above approximately 50 to 60° C. For this purpose, water and/or steam needs to be added only via the common water supply, e.g. in the case of a cooking appliance via the nozzles, via which water and/or steam is otherwise also injected for the cooking operation, so that water then also runs into the outlet and dissolves the cleaning and/or rinsing agent molded article there.

This liquid cleaning agent can then be conveyed through a line system of the appliance or of the commercial cooking appliance, respectively, e.g. by means of a recirculation. In the case of a commercial cooking appliance, this line system can for example be the steam guiding system, in which the steam is generated and is then injected into the cooking chamber.

The liquefied cleaning agent can optionally also be transferred into a recirculation container or storage tank, respectively, as part of this line system, wherein the liquefied cleaning agent can initially be further diluted, if applicable by adding further solvent, in particular fresh water, before it then passes through the remaining cycle once or several times, so as to automatically carry out the cleaning process. A return of the liquid cleaning agent thereby preferably takes place again via nozzles into the interior of the appliance, in particular the cooking chamber of the commercial cooking appliance.

Fresh water can optionally be used to rinse again when the cleaning process ends, i.e. after a cleaning of the interior with the cleaning agent and the discharge of the used cleaning agent, and/or a further rinsing process, in particular a rinsing phase, can be carried out by means of a rinsing agent. The rinsing agent can subsequently also be transferred into the optional recirculation container or storage tank, respectively, if applicable further diluted by supplying solvent, and can be transported into the interior, if necessary, by means of a pump.

After the cleaning or rinsing, respectively, of the interior has ended, the used cleaning or rinsing solution, respectively, can drain via the outlet opening in the interior and can subsequently be discharged and disposed of via a pump. For this purpose, an outlet valve can preferably be provided, so as to switch between a returning for a cleaning process or a discharging of the used cleaning or rinsing solution, respectively.

As already described above, the cleaning and/or rinsing agent molded article is preferably dropped from a pouch, which is particularly preferably hose-like, end face portion first, onto the bottom of the interior and/or is pushed out of this pouch, after the pouch was torn open as intended. This makes it possible that the user can introduce the cleaning and/or rinsing agent molded article into the interior or cooking chamber, respectively, without having to touch it with the fingers.

The cleaning and/or rinsing agent molded article according to the invention or the use thereof according to the invention, respectively, as well as the method according to the invention thus provide for an exact individual metering of a cleaning or rinsing agent, respectively, without the risk that the cleaning agent or the rinsing agent, respectively, is spilled or splashes, and that skin or eye contact with the user takes place otherwise. This means that for each cleaning process or rinsing process, respectively, of the cooking appliance, a cleaning and/or rinsing agent molded article is introduced into the interior, which contains the quantity of cleaning or rinsing agent, respectively, required for a cleaning process or rinsing process, respectively.

In the case of a method according to the invention for the production of such a cleaning and/or rinsing agent molded article, a pressed material to be compressed, for example a powder or granules, respectively (i.e. a granular powder) comprising the or consisting of the cleaning and/or rinsing agent, is pressed to form a roller with a roll surface, which has two end faces connected by the roll surface, wherein at least on one of the two end faces, preferably only on one of the end faces, the cleaning and/or rinsing agent molded article has an end face portion, which is designed so that the cleaning and/or rinsing agent molded article falls sideways onto the roll surface if it impacts or is placed against a solid surface with the relevant end face. As already described above, an advantageous pressed material is present in the form of a powder or of a granulate, which preferably has a grain size distribution, in the case of which more than 50%, particularly preferably more than 75%, most preferably more than 90% lie within the grain size range of approximately 200 μm to 1600 μm.

A corresponding device for the production of a cleaning and/or rinsing agent molded article has a tablet press comprising at least one mold, for example comprising a die and a lower and upper punch, as well as a supply unit for supplying the pressed material comprising the or existing of the cleaning and/or rinsing agent to the mold for pressing the cleaning and/or rinsing agent molded article, and a unit for removing the cleaning and/or rinsing agent molded article from the mold, for example a type of scraper mechanism or the like. The mold as a whole is designed so that the pressed material is pressed to form a roller with a roll surface, which is formed as described above. The device can preferably be a concentric tableting machine, e.g., which, on a disk-shaped, generally circular rotor disk along a circumference, has a plurality of bores or the like, in which a plurality of dies are arranged, wherein a lower punch and an upper punch are assigned to each die. The lower punches and upper punches are mechanically controlled with the help of so-called filling curves during a rotation of the rotor in the usual way in their position, so that the molded articles are pressed accurately as a result of the movement of the punches at the different rotational positions (stations).

Further particularly advantageous embodiments and further developments of the invention follow from the description below, wherein features of different exemplary embodiments can be combined into new exemplary embodiments.

As already mentioned, the end face portion of the cleaning and/or rinsing agent molded article can be formed in different ways. In the case of a preferred variation, it is formed in a substantially dome-shaped manner, i.e. curved convexly to the outside or formed conically.

The cleaning and/or rinsing agent molded article furthermore has a number of cavities in its surface, preferably at least in the roll surface. Such cavities have the advantage that the surface of the cleaning and/or rinsing agent molded article, which comes into contact with the solvent, is larger and that the quick dissolution of the cleaning and/or rinsing agent molded article during the cleaning or rinsing process, respectively, is thus facilitated.

The cavities are preferably grooves. On principle, they can be arranged so as to be annularly circumferential in the roll surface. Particularly preferably, however, at least one groove, preferably a plurality of grooves, runs in the longitudinal direction of the roll surface, i.e. parallel to the axis of rotation of the molded article. Particularly preferably, these grooves run from an end face across a partial portion of the roll surface.

In the case of the production method, the cavities, in particular the grooves, can simply also be pressed in, preferably in response to the pressing. To form the grooves, the mold can preferably have at least one inwardly directed bar, which points to the inside, by means of which the groove is then molded into the cleaning and/or rinsing agent molded article. As will be described later by means of an exemplary embodiment of a preferred device, it is particularly advantageous if the grooves run in the longitudinal direction of the roll surface from an end face across a partial portion of the roll surface. The bars can then extend radially to the inside for example in the die and the bottom punch can have corresponding grooves. These bars would thus have a double function, namely firstly the introduction of the desired grooves into the cleaning and/or rinsing agent molded article, and, secondly, they form a good guide for the lower punch. Particularly preferably, the grooves extend along the roll surface from the end face, which does not have the tapering end face portion.

In addition to the formation of the form of the end face portion, further parameters of the setup of the cleaning and/or rinsing agent molded article, such as, e.g. total size and form, can also contribute, as mentioned, to the fact that the cleaning and/or rinsing agent molded article always falls sideways onto the roll surface in a secure manner.

On the one hand, this can be supported by the size of the end face portion relative to the total length of the cleaning and/or rinsing agent molded article, i.e. that for example the cylindrical base portion of the cleaning and/or rinsing agent molded article is significantly longer than the end face portion. The end face portion is preferably maximally 40%, particularly preferably maximally 30%, most preferably maximally 25% of the total length of the cleaning and/or rinsing agent molded article, measured in the longitudinal direction thereof, i.e. from the one end face to the other end face, wherein the end face portion or portions are counted as well. The actual base body comprising the roll surface thus has the largest portion of the mass, thus for example the cylinder body, so that the center of gravity also lies accordingly. The total length of the cleaning and/or rinsing agent molded article is preferably maximally 60 mm and particularly preferably maximally 50 mm.

An advantageous center of gravity arrangement can also be supported in that the density along a longitudinal axis of the cleaning and/or rinsing agent molded article varies. In a range, which is spaced apart from the end face portion, thus e.g. in the cylindrical or central range, respectively, the density of the cleaning and/or rinsing agent molded article is then higher than at the end face portion. Density differences can be reached in response to the pressing in that it is ensured that pressed material is used in a plurality of layers with different granularity or different pressing behavior/compression, respectively. For example, finer particles can be used in the regions, in which a higher density is to be reached, than in the regions, in which the density is to be lower. Different materials, in particular fillers, can likewise be used in the different layers.

As already mentioned above, the cleaning and/or rinsing agent molded article can be formed as pure cleaning agent molded article but also as pure rinsing agent molded article. It is also possible, however, that the cleaning and/or rinsing agent molded article serves for the cleaning as well as for the rinsing and has for example certain portions or regions, which are formed as cleaning agent, and other regions, which are formed as rinsing agent. This can in particular be realized in different layers of the cleaning and/or rinsing agent molded article. These layers can for example be arranged on top of one another perpendicular to the longitudinal axis, but also parallel to the longitudinal axis. It is likewise possible to provide regions, which differ radially from the inside to the outside, for example a rinsing agent core comprising an external coating of cleaning agent. Certain embodiments can thereby contain the rinsing agent in gel form, which preferably melts only at a temperature above approximately 50 to 60° C., particularly preferably above approximately 70° C., in particular preferably above approximately 75° C. The cleaning agent can initially act at a temperature below the melting temperature of the rinsing agent in this way and the rinsing agent can subsequently be liquified at a temperature above approximately 50 to 60° C.

As mentioned, the cleaning agent molded article preferably contains a highly alkaline cleaning agent. The alkaline properties of the cleaning agent can be influenced by means of its content of alkaline components. In a preferred cleaning agent molded article, a significantly higher concentration can be reached by the use of for example caustic soda and metasilicate than in a liquid cleaner, which typically contains less than 30% by weight of caustic soda. Alkaline contents of up to 85% by weight can thus be reached in an advantageous cleaning agent molded article.

In a preferred embodiment, the cleaning agent comprises an alkali system of one or a plurality of components, which are selected from caustic soda (highly concentrated NaOH) and metasilicate and which is supplemented by Na-carbonate (soda) or more rapidly dissolving potassium carbonate. These components provide the cleaning agent with a high alkalinity. An alkaline cleaning agent in terms of the invention is a cleaning agent molded article comprising an alkali system, which, when dissolved in water, that is, in an approximately 1% aqueous solution, preferably provides the molded article with an alkaline pH value, more preferably with a pH value greater than 10, particularly preferably with a pH value greater than 12.

One or combination of a plurality of the mentioned alkaline components can thereby be used in the alkaline cleaning agent or in combination with additional alkaline agents, respectively, to set the alkalinity (also referred to as "basicity") in an advantageous manner. A setting of the pH value to the above-mentioned preferred alkaline value is often already sufficient for the releasing fats and proteins from contaminated surfaces, wherein alkaline-based cleaning agents can also have a cleaning effect, which is based on complex-forming groups or surface-active groups, as long as they can take effect in an alkaline environment (pH value greater than 10). Protein-denatured alkaline substances can also be used as components of the cleaning agent, as long as they can take effect in an alkaline environment.

The cleaning agent molded article according to the invention contains the alkaline components of the alkali system, preferably in a total quantity of approximately 20 to 85% by weight, particularly preferably in a percentage of approximately 40 to 60% by weight, based on the total cleaning agent molded article.

These highly alkaline components are preferably added to the cleaning agent during the production thereof, whereby it also falls under the invention, if they completely or partly convert into more stable products, e.g. into hydrates or oxides, etc., in the cleaning agent, as long as this conversion are reversible again when using the cleaning agent molded article or the dissolution thereof in water, respectively, so that the desired alkalinity is provided.

In a further preferred embodiment, the cleaning agent molded article according to the invention can comprise further complexing agents, matrix components, builders and excipients.

The cleaning agent molded article can thereby also contain a complex forming component comprising a combination of complexing agents or complexing excipients, respectively, to bind metals or metal ions, respectively, in particular calcium and magnesium, from hard water and from the food contaminations dissolved in response to the cleaning process. Phosphates (e.g. Na-triphosphate) are known predominantly as highly effective complexing agents.

However, phosphate-free complexing agents, such as, for example, methylglycinediacetic acid (MGDA) and/or polyaspartic acid or the salts thereof, polyepoxysuccinic acid (PESA) or the salts thereof and/or gluconic acid or gluconates and/or polymers and copolymers (e.g. polycarboxylates) and/or phyllosilicates and/or citric acid or citrates, etc. can also be used.

If a complexing agent is to contain only a small percentage of phosphate, alkali-stable phosphate or phosphate-containing additives, such as, for example, phosphonates (e.g. salts of the nitrilotrismethylene phosphonic acid) of the Sequion types (manufacturer: e.g. Polygon Chemie, Olten, Switzerland) or Cublen-types (manufacturer: e.g. Zschimmer & Schwarz, Lahnstein, Germany) can be used as additional complexing agents.

The complex forming component and further complexing agents are preferably used in a total quantity of not more than 10 to 40% by weight, particularly preferably with a percentage of approximately 15 to 25% by weight, based on the total weight of the cleaning agent molded article. The complexing agents preferably have a good water solubility.

In addition to the alkaline components and the complexing agents, surface-active substances are used for the cleaning. These substances, which are also identified as surfactants, are to advantageously form as little foam as possible, so as to already avoid an excessive formation of foam from the outset. Preferred surfactants are, for example, fatty alcohol ethoxylates, in particular low-foam terminal group closed, non-ionic surfactants (e.g. Plurafac-types by the manufacturer BASF, Ludwigshafen, Germany), glucosides (manufacturer: e.g. Akzo Nobel, Cologne, Germany) or fatty amines. Even though anionic surfactants are conceivable, they have a lower relevance, because they often form a lot of foam. Surfactants are preferably used in a quantity of approximately 0.2 to 20% by weight, particularly preferably in a percentage of approximately 0.5 to 5% by weight of the cleaning agent molded article.

Further components of the cleaning agent can additionally comprise one or a plurality of builders, such as, for example, water-soluble sulfates (e.g. Na-sulfate) and/or excipients, in particular for example binding agents, molded article excipients, disintegrating agents, dissolution inhibitors, retarding agents or lubricants.

The builders are preferably used in a quantity of not more than 20% by weight, particularly preferably in a percentage of not more than 10% by weight of the cleaning agent molded article. Preferred builders thereby have a high water solubility.

Preferred binding agents or molded article excipients are selected from starches, celluloses, polyethylene glycol (PEG), calcium compounds, bentonite, polysaccharides, sugar compounds, proteins and/or synthetic polymers, among others.

Exemplary disintegrating agents are starches (microcrystalline) celluloses, alginates, polysaccharides, proteins, cross-linked polyvinyl pyrrolidone, polymethacrylate derivatives or bentonites, among others.

Exemplary dissolution inhibitors or retarding agents, respectively, are waxes, ethyl celluloses, fats, polyvinyl acetate, carboxymethyl cellulose, polyacrylic acid, polyethylene glycol (PEG), gels or stearates, among others.

Fatty acid esters, talcum, oils and fats or fatty acids, respectively, or pyrogenic silica can be named as exemplary lubricants.

According to the desired properties of the cleaning and/or rinsing agent molded article, for example with regard to the stability and solubility thereof, as well as to ensure the pressability, a suitable combination of different excipients or builders is used, depending on the area of application.

An adhesive can preferably also be used, which intensifies the adhesion within the cleaning and/or rinsing agent molded article or between different layers of the cleaning and/or rinsing agent molded article. For example, polyethylene glycol (PEG) can be introduced as powder into the cleaning and/or rinsing agent molded article for this purpose.

According to the invention, a rinsing agent molded article is present as solid. Insofar as only one layer or one region, respectively of a cleaning and/or rinsing agent molded article comprises the rinsing agent, however, the latter can be present as solid, solid or liquid gel or also in the form of a liquid. If a liquid gel or liquid is to be used in the core, it is preferably also coated by a boundary layer, which will be described below, on which the sleeve or layer, respectively, of solid cleaning agent is then located on the outside. Such rinsing agents are known in general and can be used in terms of the present invention. A preferred composition of a rinsing agent can contain one or a plurality of acids, such as, for example, citric acid, malic acid, adipic acid and/or amidosulfonic acid as well as a surfactant, particularly preferably a non-ionic surfactant, in particular a low-foam non-ionic surfactant. For a preferred rinsing agent molded article, these active components can be supplemented by the above-mentioned builders and/or tableting excipients.

To ensure a sequential and defined succession of the cleaning and rinsing processes, an above-mentioned boundary layer of the cleaning and/or rinsing agent molded article, which separates the cleaning agent and the rinsing agent, can be designed so that it melts at a temperature, which is higher than a temperature for dissolving the cleaning agent. This results in an advantageous manner that a release of the rinsing agent takes place only in response to a heating to a defined temperature for dissolving the boundary layer. Advantageously, such a boundary layer melts at a temperature of above 70°, preferably at a temperature of above 750°, in particular at a temperature of above 80° C. Such a boundary layer preferably comprises a substance selected from a polyvinyl alcohol (PVA).

In the alternative, however, the rinsing agent can also be added separately into the machine or the cooking appliance, respectively, as liquid or in the form of a powder or granulate, respectively. Such a rinsing agent, which is set to be acidic, can be set so that it is not identified as being "corrosive", but only as being "irritating", so that a contact with the skin as compared to a cleaner, which is set to be highly alkaline, has only little effect.

The invention will be described once again below in detail with reference to the enclosed figures by means of exemplary embodiments. Identical components are thereby provided with identical reference numerals in the various figures. The figures are generally not true to scale.

In the exemplary embodiments described below, the cleaning and/or rinsing agent molded article is a highly alkaline cleaning agent molded article, which is used to clean a commercial cooking appliance. However, it is expressly pointed out once again that this is only a preferred exemplary embodiment and that the molded article can also contain rinsing agent components or can be formed as pure rinsing agent mold. A cleaning and/or rinsing agent molded article of this type can likewise also be used to clean the interior of other appliances in the gastronomy and/or food production sector.

Figure 1:
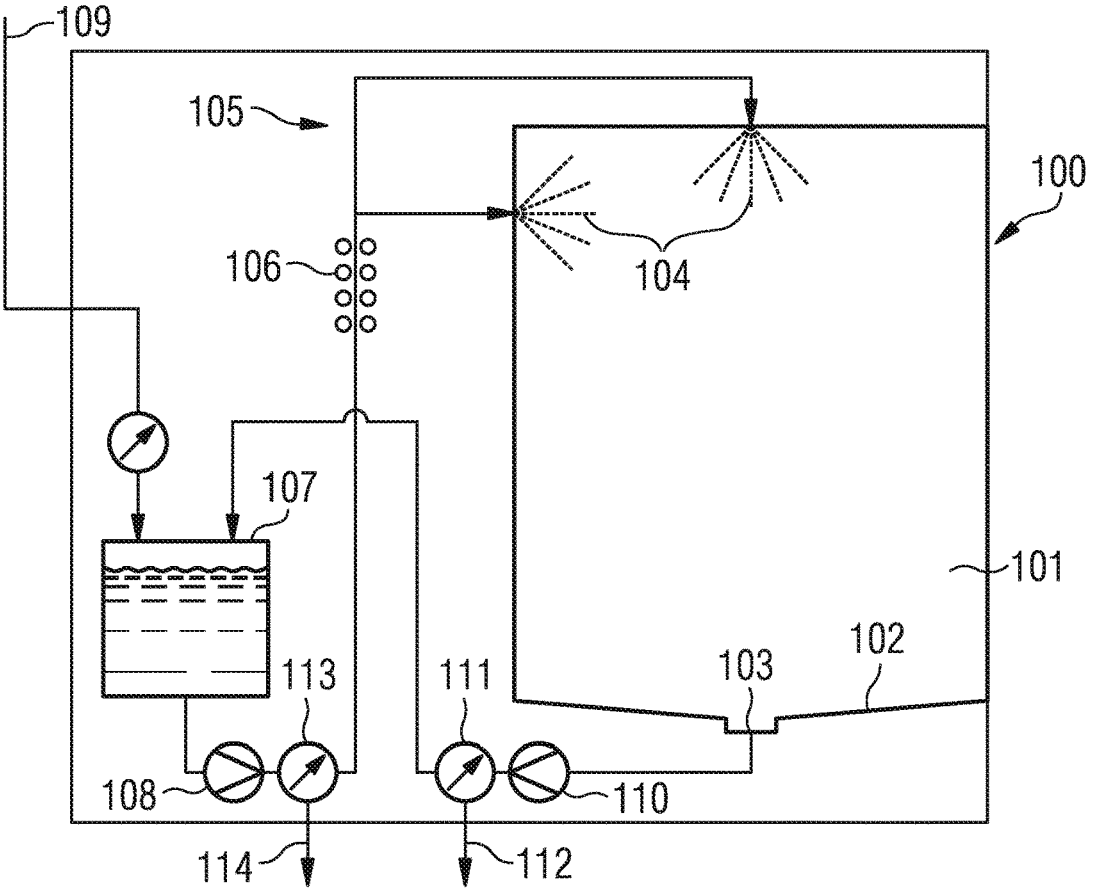
FIG. 1 shows a schematic illustration of an exemplary embodiment of a commercial cooking appliance.

FIG. 1 shows, roughly schematically, a cooking appliance 100, here a commercial combination steamer, comprising a cooking chamber 101, into which the food to be cooked, which is to be heated, in particular to be cooked, or the dishes, respectively, is introduced via a (non-illustrated) door during operation. Fittings (which can possibly be removed), such as rail systems, holders or the like, are usually also located in the cooking chamber 101, so as to hold baking sheets, oven-proof dishes, etc., which are formed so as to match them. For the sake of clarity, these fittings are not illustrated here. It is clear that such a combination steamer can also have all of the further usual components, such as, e.g. fans, heating devices for the walls of the cooking chamber, overhead grills, steam generators, as well as a suitable controller for controlling the entire appliance during use when preparing the dishes, but also during the cleaning.

Water, in particular fresh water, for creating water vapor in the cooking chamber 101, can be applied to the cooking chamber 101 via a fresh water supply 109 and a line system 105, which forms a recirculation cycle, or water vapor can be applied directly. The cooking chamber 101 itself, with or without fittings, as well as the line system 105 for the water or the water vapor, respectively, need to be cleaned on a regular basis. A cleaning and/or rinsing agent molded article 1, 1', 1" according to the invention can be used for this purpose, as it will be described later. A trace heating 106 of the line system 105 can heat solvents, in particular fresh water or also the cleaning solution itself to a desired temperature. Such a trace heating 106 can in particular be designed electrically, for warm water or for condensing water vapor. The solvent or the cleaning solution, respectively, can thus be introduced or injected, respectively, into the cooking chamber 101 of the cooking appliance 100 via inlet openings 104, in particular nozzles 104. There, it flows into an outlet nozzle 103, which is arranged at the lowest point of a bottom 102, which tapers obliquely in the direction of the outlet nozzle 103. Prior to the start of a cleaning process, as described below, a cleaning agent molded article 1, 1', 1" is opinioned in this outlet nozzle, for example on an outlet screen in the outlet nozzle 103. The cleaning agent molded article 1, 1' 1" is dissolved by means of the warm or hot water, respectively, which drains via the outlet nozzle, and the liquefied cleaning agent or cleaning concentrate, respectively, formed thereby is conveyed into the line system 105 via a pump 110.

As part of the line system 105 or recirculating cycle, respectively, the cooking appliance 100 comprises a recirculation container 107, which can also serve as storage tank 107 for a cleaning solution. The cleaning concentrate is conveyed through the pump 110 into this recirculation container 107 here. Fresh water can then additionally be supplied into the recirculation container 107 as solvent via the fresh water supply 107 for the further dilution of the cleaning concentrate. For the improved solution and mixing for receiving a cleaning solution with the desired concentration or alkalinity, respectively, the recirculation container 107 can have a (non-illustrated) mixing device, such as for example a stirring unit. To clean the cooking chamber 101 and the line system 105, the cleaning solution provided in the recirculation container 107 can be introduced into the cooking chamber 101 again by means of a further pump 108 via the line system 105 and via the nozzles 104.

During and after ending the cleaning of the cooking chamber 101, the used cleaning solution can drain from the cooking chamber 101 again via the outlet nozzle 103 and can subsequently be pumped further via the pump 110. It can be set thereby via an outlet valve 111 whether cleaning solution coming from the cooking chamber 101 is pumped back into the line system 105 or the recirculation container 107, respectively, for a new run-through, or whether it is discharged via an outlet line 112 and is disposed of properly. In addition or in the alternative, the cleaning solution can also be pumped out of the recirculation container 107 via the pump 108, an outlet valve 113 and an outlet line 114. Fresh water can optionally be used to rinse again after ending the cleaning process.

Figure 2:
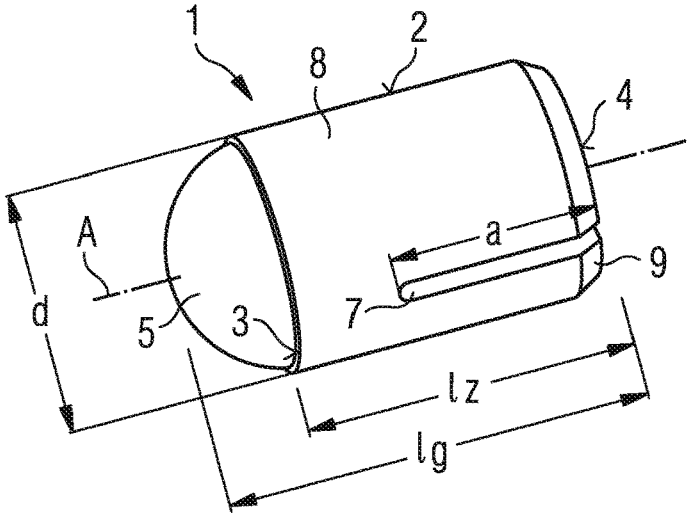
FIG. 2 shows a first perspective view of a first exemplary embodiment of a cleaning agent molded article.
Figure 3:
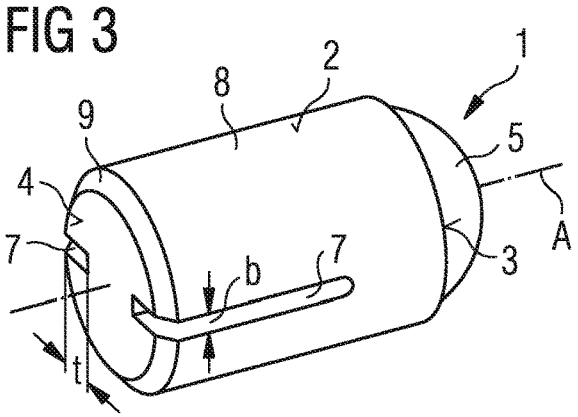
FIG. 3 shows a second perspective view of the first exemplary embodiment of a cleaning agent molded article.

FIGS. 2 and 3 show a preferred form of a cleaning and/or rinsing agent molded article 1 (as mentioned here of a cleaning agent molded article 1) in each case in a perspective obliquely from the front in FIG. 2 and obliquely from the rear in FIG. 3.

This cleaning agent molded article 1 is formed as roller, namely comprising a cylinder portion 8 comprising a cylinder jacket surface, which forms the roll surface 2. This cylinder jacket surface or roll surface 2, respectively, connects two end faces 3, 4 of the cylinder portion 8. An end face portion 5, which is designed in a dome-shaped manner, in the present case in a hemispherical manner, and which is pressed in one piece with the cylinder portion to form the roller or cleaning agent molded article 1, respectively, is located on an end face 3.

A small circumferential ledge-like edge is located on the relevant end face 3 so as to rotate about the end face portion 5 here, i.e. the diameter of the end face portion 5, which adjoins the cylinder portion 8, is smaller than the diameter d of the cylinder portion 8. This ledge has production-related reasons, because it is thus reliably avoided that a bead or the like, which protrudes outwards beyond the cylinder jacket surface 2, is created, which could prevent the roller from smoothly rolling along the roll surface 2 or cylinder jacket surface 2, respectively. On principle, however, a completely smooth transition could also be present between the cylinder portion 8 and the end face portion 5.

The opposite end face 4 is formed so as to be flat here. However, a chamfer 9, which also serves here to allow for a rolling on the roll surface 2 or cylinder jacket surface, respectively, as smoothly as possible, is located at the transition to the cylinder jacket surface 2, so that the roller also rolls off evenly around its longitudinal axis A or axis of rotation A, respectively.

From the flat end face 4, two grooves 7 extend radially opposite one another parallel to the longitudinal axis A, i.e. along the longitudinal direction of the roll surface 2. The length a of the grooves 7 parallel to the longitudinal axis A is approximately two-thirds of the length $l_Z$ of the cylinder portion 8 and approximately half of the total length $l_G$ of the cleaning agent molded article 1 in the direction of the longitudinal axis A.

The entire cleaning agent molded article 1 is dimensioned so that it includes the matching dosage for an individual cleaning process of the cooking appliance 100. To that extent, the dimensioning also depends on the recipe. In the case of the below-mentioned sample recipes, the diameter d is preferably at least 15 mm, preferably at least 25 mm. Maximally, it is preferably 40 mm and particularly preferably maximally 30 mm. The total length $l_G$ is preferably at least 45 mm, particularly preferably at least 40 mm. Maximally, the total length $l_G$ is 60 mm and particularly preferably maximally 50 mm. The length $l_Z$ of the cylinder portion 8 is preferably between 60 and 80% of the total length $l_G$. The length a of the grooves 7 is preferably at least half of the total length $l_G$, it can also extend completely through the cleaning agent molded article 1, however. It is likewise possible that the cleaning agent molded article has more than two grooves 7 of this type.

The width b of the grooves 7 is preferably at least 1 mm, preferably at least 1.5 mm. Maximally, it is preferably 4 mm and particularly preferably maximally 2.5 mm. The depth t of the grooves 7 is preferably at least 3 mm, preferably at least 5 mm. Maximally, it is preferably 12 mm ad particularly preferably maximally 10 mm.

A method for the production of the cleaning agent molded article 1 with such grooves will be described later by means of FIGS. 10 to 15.

Figure 4:
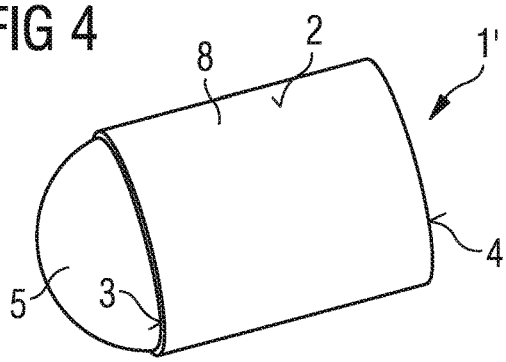
FIG. 4 shows a first perspective view of a second exemplary embodiment of a cleaning agent molded article.
Figure 5:
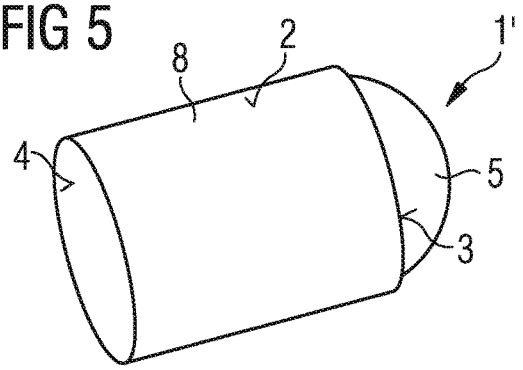
FIG. 5 shows a second perspective view of the second exemplary embodiment of a cleaning agent molded article.

FIGS. 4 and 5 show a second, simpler variation of a cleaning agent molded article 1' according to the invention, in each case from the same perspectives as FIGS. 2 and 3 for the first variation of the cleaning agent molded article 1.

This cleaning agent molded article 1' essentially differs from the first variation in that the chamfer 9 at the transition between the flat end face 4 and the roll surface 2 or cylinder jacket surface, respectively, of the cylinder portion 8 was forgone here and in that grooves 7 were also not introduced.

Figure 6:
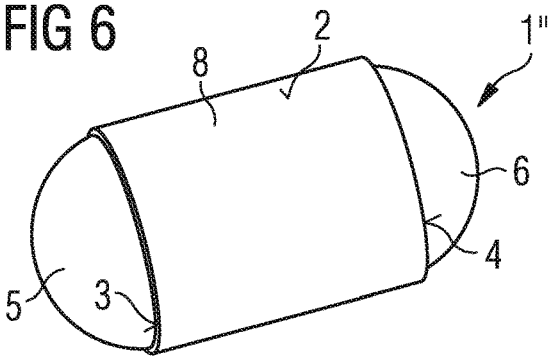
FIG. 6 shows a first perspective view of a third exemplary embodiment of a cleaning agent molded article.

FIG. 6 shows a third exemplary embodiment in a perspective view. Here, the cleaning agent molded article 1" in each case has dome-shaped or hemispherical end face portions 5, 6, respectively, on both end faces 3, 4.

The loading of a cooking appliance for the cleaning process with such a cleaning agent molded article will now be explained by means of FIGS. 7 to 9, wherein the cleaning agent molded article 1' according to the second variation is used here in a simplified manner as example. On principle, however, the method works in the same way with every other cleaning agent molded article 1, 1', 1" according to the invention.

Figure 7:
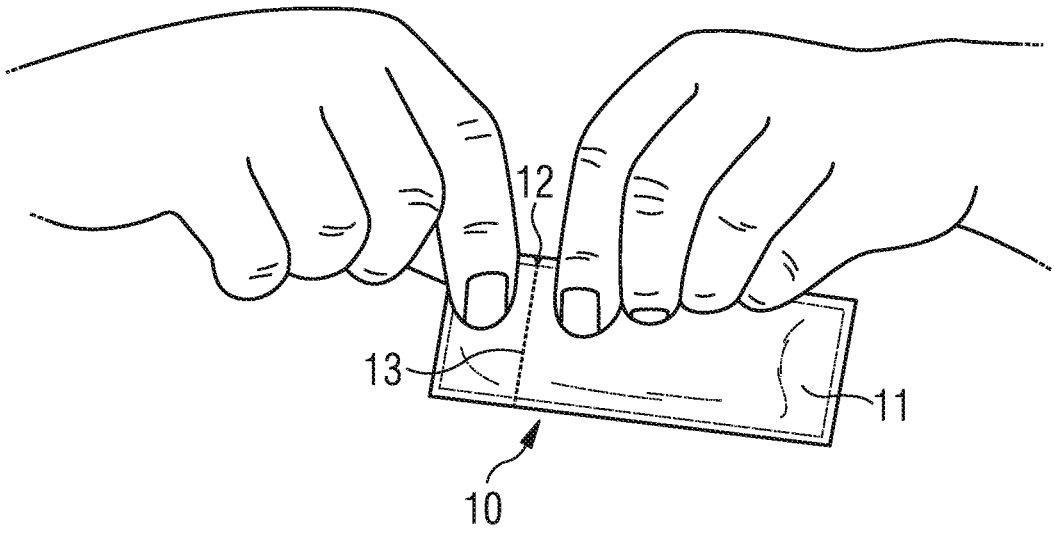
FIG. 7 shows an illustration of an exemplary embodiment of a cleaning product comprising a sealed pouch, in which a cleaning agent molded article according to the first exemplary embodiment is located, prior to tearing open the pouch for introducing the cleaning agent molded article into a commercial cooking appliance for the cleaning thereof.
Figure 8:
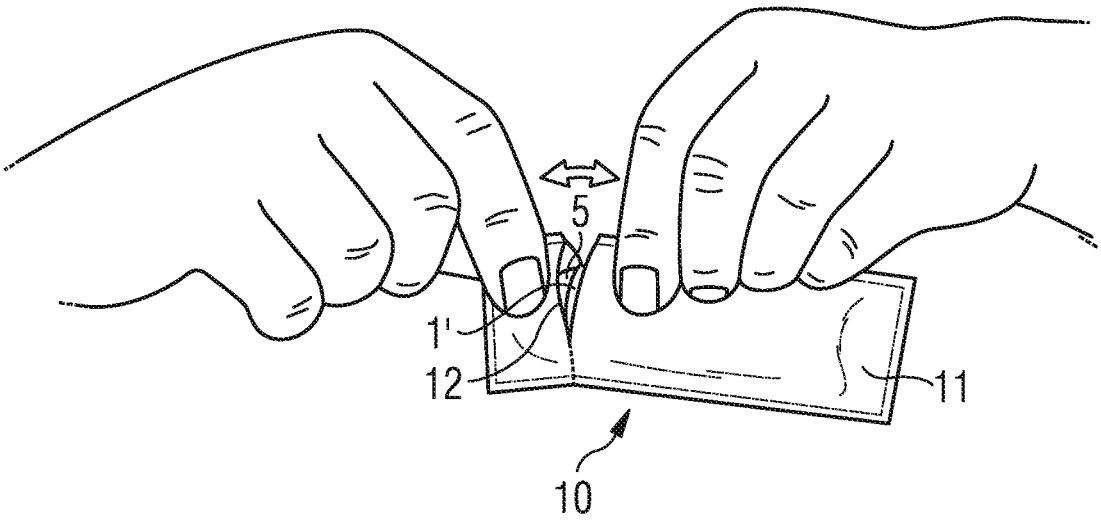
FIG. 8 shows an illustration of the cleaning product according to FIG. 7 while tearing open the pouch for introducing the cleaning agent molded article into the commercial cooking appliance.

First of all, FIG. 7 shows initially, how a user, who wants to start the cleaning process of the cooking appliance 100, holds a cleaning product 10, which consists of a cleaning agent molded article 1', which is arranged in a sealed, tube-like pouch 11, in his hands. A tear notch 12, which is followed by a predetermined breaking seam 13, is arranged on the pouch 11 on a longitudinal edge, adjacent to a narrow side, on which the tapering end face portion 5 of the cleaning agent molded article 1' is located. By tearing open this tearing notch 12, the user can tear off the upper end of the pouch 11, as illustrated in FIG. 8, so that the side of the tube-like pouch 11, at which the end face portion 5 of the cleaning agent molded article 1' is located or the relevant end face portion 5 already protrudes from the pouch 11, respectively, is open.

Figure 9:
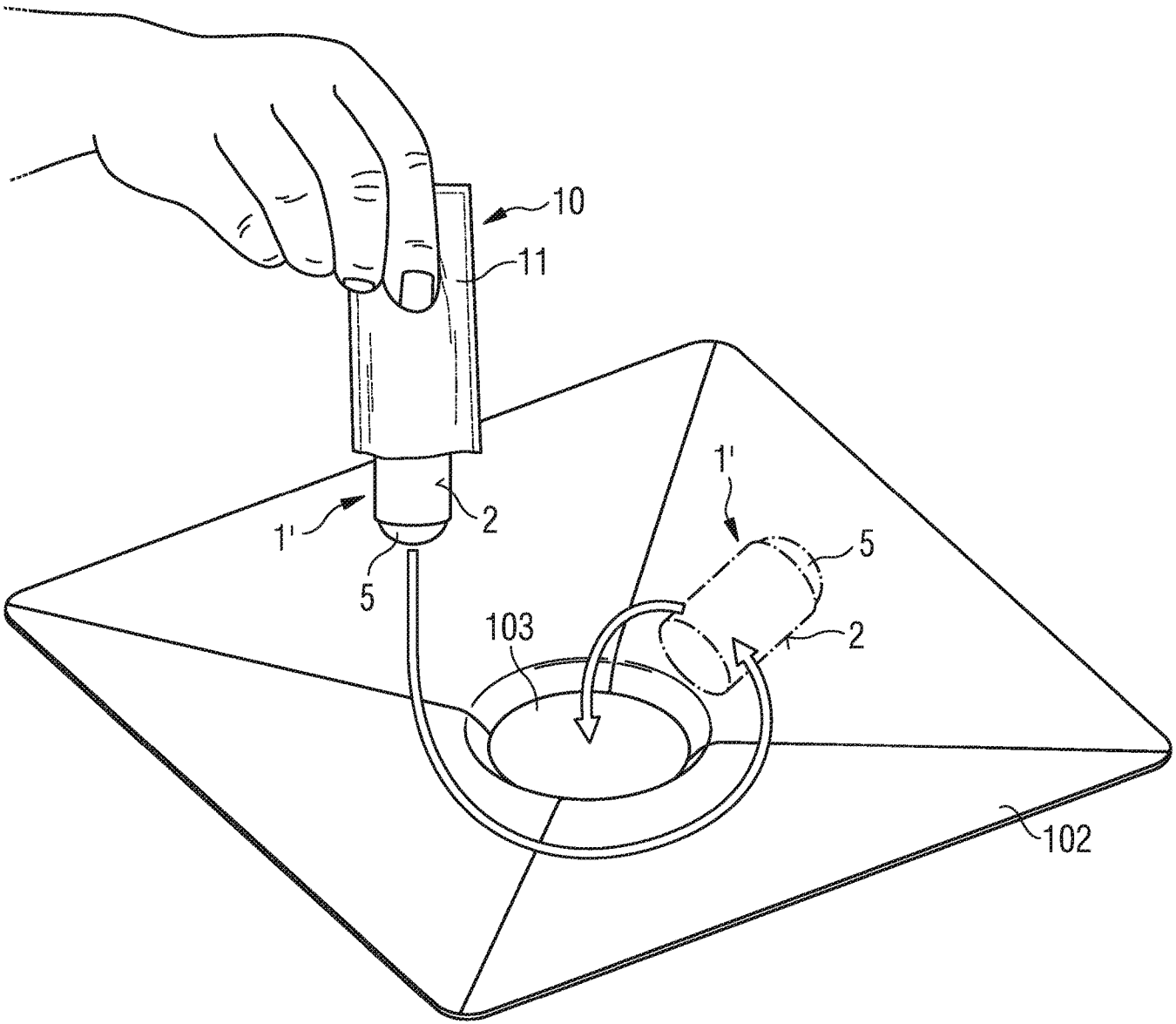
FIG. 9 shows an illustration of the cleaning product according to FIG. 7 after tearing open the pouch in response to the introduction of the cleaning agent molded article into the commercial cooking appliance and the positioning in the drain.
Figure 12:
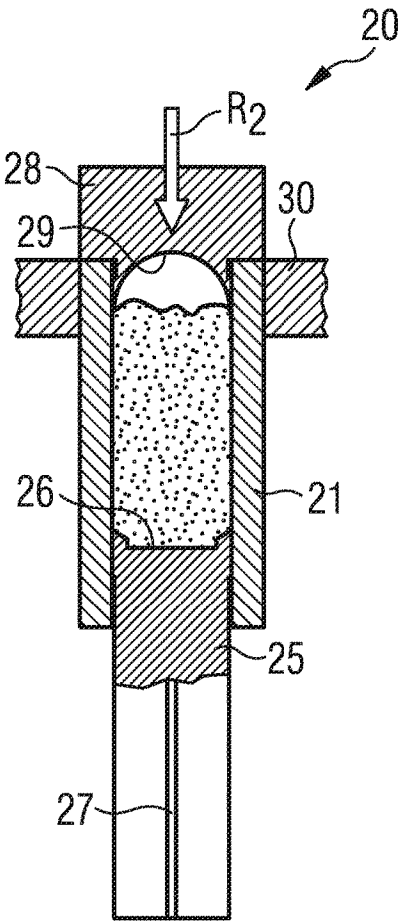
FIG. 12 shows a rough schematic illustration of the mold according to FIG. 10 in a third operating state.

As shown in FIG. 9, the user can then, without touching the cleaning agent molded article 1', simply let the latter fall down out of the pouch 11, end face portion 5 first, or can push it out of the pouch 11, respectively. This can take place at any location just above the bottom 102 of the cooking chamber 101 of the cooking appliance 100. As already described above, the bottom 102 is formed as oblique surface, which runs from all side towards an outlet nozzle 103. If the cleaning agent molded article 1' then impacts with the tapering end face portion 5 first, i.e. here with the hemisphere first, against the surface of the bottom 102, it automatically falls onto the roll surface 2 and then always rolls along the inclined surface downwards in the direction of the outlet nozzle 103, until it falls into the outlet nozzle 103 or is located in an outlet screen (not illustrated) arranged thereabvoe.

Regardless of where the use drops the cleaning agent molded article 1' from the pouch 11 onto the bottom 102, it is thus ensured that it always comes to rest at the same defined position, namely in or above the outlet nozzle 103, and that the same conditions for the dissolution of the cleaning agent molded article 1' are thus always present in the cleaning process. It is thereby in particular not important that the user places the cleaning agent molded article 1' on the bottom 102 in the vicinity of the outlet nozzle 103, which is often not possible, because the access to the outlet nozzle 103 can be quite intricate as a result of fittings in the cooking chamber 100.

A preferred method and a preferred device for the production of a cleaning and/or rinsing agent molded article 1 according to FIGS. 2 and 3 will now be illustrated by means of FIGS. 10 to 15 as well as 16 to 18. The production of the other cleaning and/or rinsing agent molded articles 1, 1', 1" can take place in a similar way.

The device is for example a tablet press in the form of a concentric tableting machine comprising a circular disk-shaped rotor 30, on which, along any circumference, a number of holes is arranged, in which a press chamber 21, a so-called die 21 of a mold 20, is arranged in each case. This means that the tableting machine includes a plurality of molds 20 of this type, which are in each case formed of the die 21, which is arranged in the rotor 30, and the lower punches 25 and upper punches 28, which are in each case assigned to the individual dies 21. The dies 21 are (except for bars 23, which will be described below and which extend into an interior 22) are formed like a simple cylinder tube comprising an outer diameter, which is dimensioned so as to match a bore in the rotor 30, in order to hold the die 21 in the rotor 30. The lower punches 25 and upper punches 28 are in each case mechanically coupled to the rotor 20, so that they can be moved a certain distance into the die 21 and can be retracted again, in order to press the press material P in the mold 20. The respective positions of the lower punches 25 and of the upper punches 28 are controlled with the help of so-called filling curves, i.e. control curves, which mechanically control the movement of the punches from station to station, while the rotor is moved forward in a direction of rotation. However, these mechanisms and the setup of the rotor 30 or of a concentric tablet press, respectively, are known to the person of skill in the art in principle, so that the rotor 30 and the components of the mold 20 are illustrated only schematically in FIGS. 10 to 15.

Figure 10:
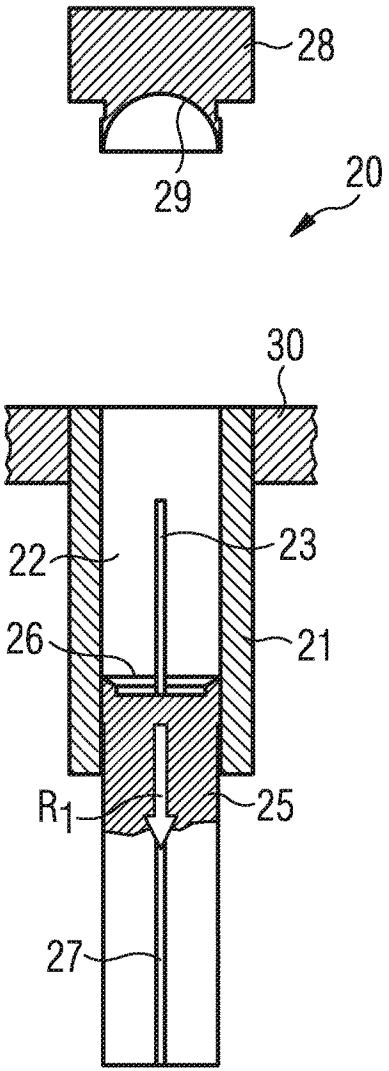
FIG. 10 shows a rough schematic illustration of an exemplary embodiment of a mold of a device for the production of a cleaning agent molded article according to the first exemplary embodiment in a first operating state.
Figure 15:
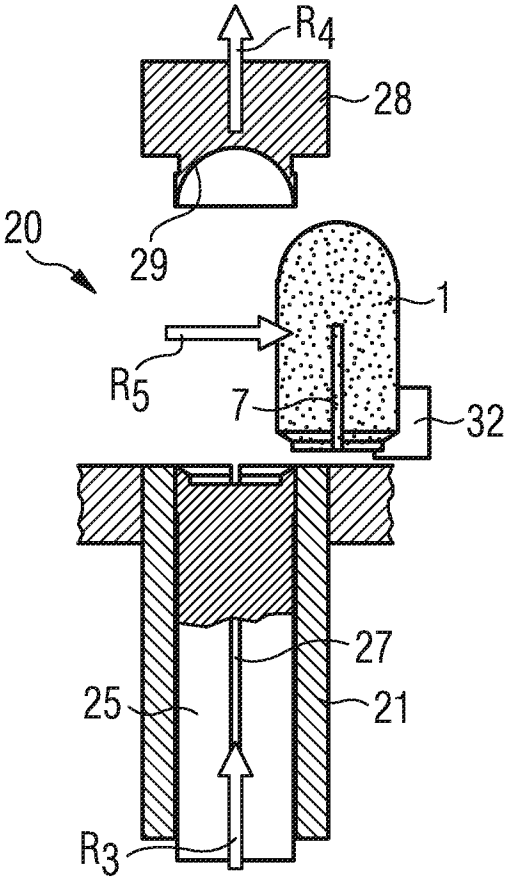
FIG. 15 shows a rough schematic illustration of the mold according to FIG. 10 in a sixth operating state.
Figure 17:
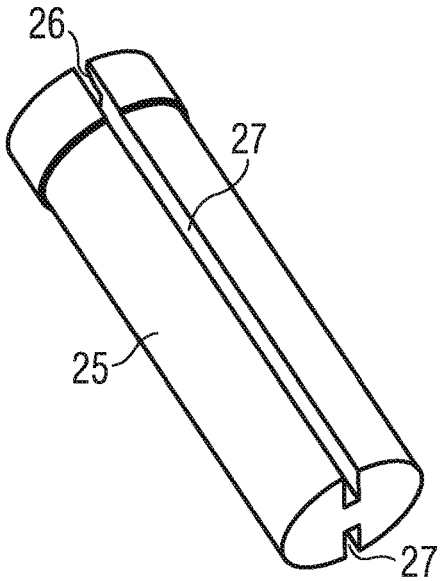
FIG. 17 shows a perspective illustration of a lower punch for the mold according to FIG. 10.

In a first station, which is illustrated in FIG. 10, the lower punch 25 is initially pulled all the way down to the desired fill depth in the direction $R_1$ prior to the filling with the press material P. The lower punch 25 is hereby guided inside the die 21 in a type of a nut-groove guide system. For this purpose, the die 21 has, in its interior 22, into which the press material P is filled and is pressed therein, two bars 23, which extend inward from the cylinder wall of the die 21 radially opposite one another and which run in the longitudinal direction of the die 21 (see FIG. 14). These bars 23 start here at a lower edge of the die 21, which is oriented towards the lower punch 25, and extend upward across approx. three-fourths of the total length of the die 21. Matching to these bars, two grooves 27 are introduced into the lower punch 25 (see FIG. 17). The lower punch 25 is guided in the interior 22 of the die 21 by means of these grooves 28 and the bars 23, so as to be capable of being displaced upward and downward.

Except for the grooves 27, this lower punch 25 is in principle formed like a round rod. On its upper end, however, it has a protrusion, in which a punch shape 26 is arranged on the inner side, which corresponds to the form of the flat end face 4 of the cleaning agent molded article 1, which is to be pressed, comprising the chamfer 9. This punch shape 26 is thus a relatively flat cavity comprising an outer edge, which tapers conically to the inside.

Figure 18:
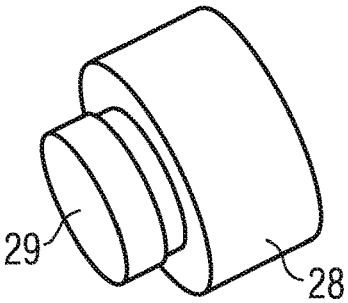
FIG. 18 shows a perspective illustration of an upper punch for the mold according to FIG. 10.

On the first station illustrated in FIG. 10, the mold 20 is open on the top, i.e. the upper punch 28 is moved completely to the top. On its lower end, this upper punch has a punch shape 29 in the form of a hemisphere curved to the inside (see FIG. 18). This part of the upper punch 28 serves to mold the dome-shaped or hemispherical end face portion 5, respectively, of the cleaning agent and/or rinsing agent molded article 1.

Figure 11:
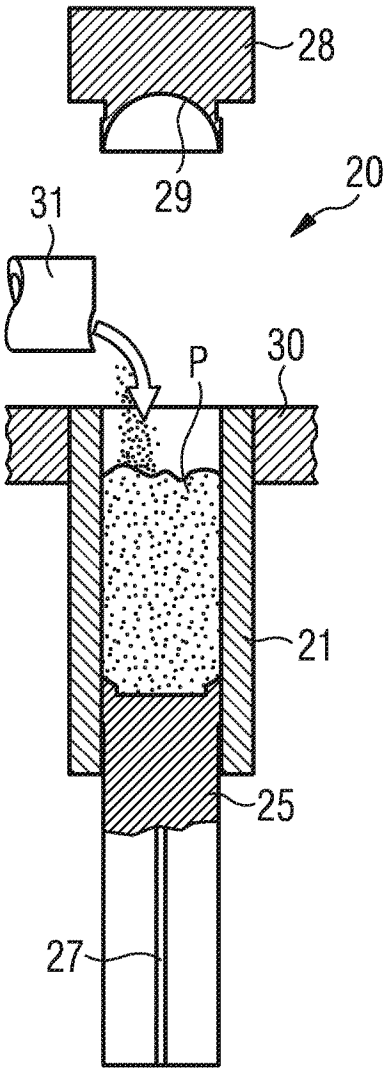
FIG. 11 shows a rough schematic illustration of the mold according to FIG. 10 in a second operating state.

In a subsequent station, the press material P is then filled into the die 21 by means of a supply unit 31, which is only illustrated schematically in FIG. 11 as end portion of a supply tube. At the next station (see FIG. 12), the upper punch 28 is subsequently inserted into the die 21 from the top along the direction $R_2$, so that the die 21 is closed on the top.

Figure 13:
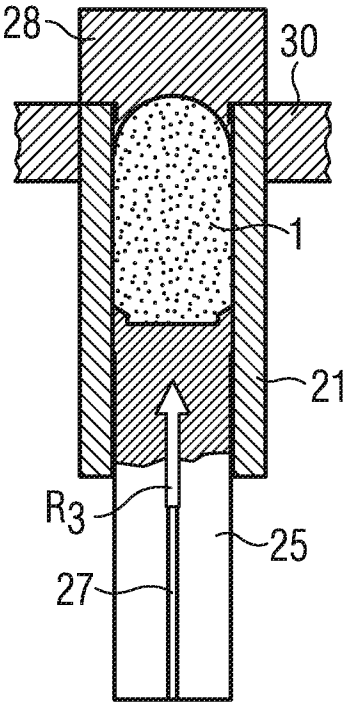
FIG. 13 shows a rough schematic illustration of the mold according to FIG. 10 in a fourth operating state.
Figure 16:
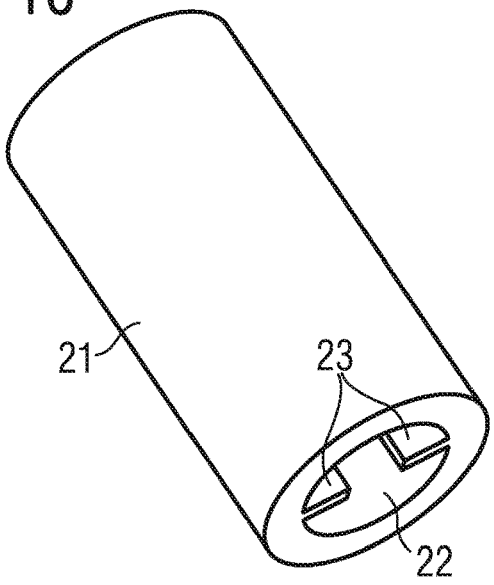
FIG. 16 shows a perspective illustration of a die (press chamber) for the mold according to FIG. 10.

Finally, the lower punch 25 is pushed upwards along the direction $R_3$ in a subsequent step, as it is shown in FIG. 13, whereby the press material P is pressed into the desired form in the mold 20. It is important to note thereby that the fill of the press material P and the tableting speed is set so that the air, which initially remained inside the dome-shaped punch shape 29 of the upper punch 29, is pushed out, i.e. the punch shape 29 is ventilated in a suitable manner.

Figure 14:
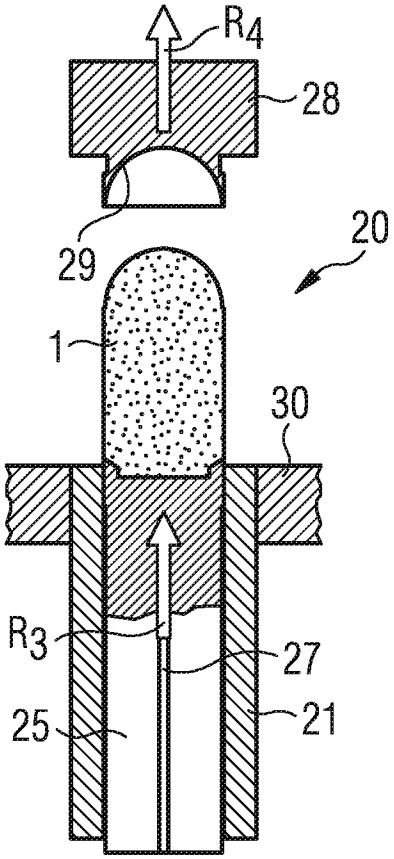
FIG. 14 shows a rough schematic illustration of the mold according to FIG. 10 in a fifth operating state.

After the pressing, the upper punch 28 can then be moved back to the top into the initial position in the direction $R_4$, as it is illustrated in FIG. 14, and the lower punch 25 is moved further to the top in the direction $R_3$, until the finished cleaning agent and/or rinsing agent molded article 1 is located outside the die 21.

At a further station, the cleaning agent and/or rinsing agent molded article 1 is then wiped off sideways from the rotor 30 in a suitable direction $R_5$ and is further conveyed to a packaging machine. The wiper mechanism 32 or device, respectively, for removing the finished cleaning agent and/or rinsing agent molded article 1, is illustrated only roughly schematically again in FIG. 15 by means of a block.

The position illustrated in FIG. 10, in which the lower punch 25 has moved back into the initial position according to the desired fill level in the direction $R_1$, can be approached again subsequently, and a further cleaning agent and/or rinsing agent molded article 1 can be pressed in this mold 20. Due to the fact that a plurality of such molds 20 is located along the rotor 30, a plurality of cleaning agent and/or rinsing agent molded articles can accordingly be produced in parallel in the corresponding clocking.

For the production of a cleaning agent molded article, for example the following recipes can be used:

TABLE 1 recipe examples for a cleaning agent molded article

| Components Cleaning agent molded article (% by weight) | Recipe 1 | Recipe 2 | Recipe 3 | Recipe 4 |
|---|---|---|---|---|
| Alkaline system | | | | |
| Caustic soda | 40 | 65 | 20 | |
| Metasilicate | 20 | 5 | 5 | 55 |
| Soda | 17 | 10 | 25 | 13 |
| Complexing agent | | | | |
| Phosphate | 17 | | | 20 |
| Citrate | | | 37 | |
| MGDA | | 6 | | |
| PESA | | 3 | | |
| Gluconate | | 8 | | |
| Phosphonate | | 1 | 0.5 | 1 |
| Polymer | 1.3 | 1 | 2 | 2 |
| Surfactants | | | | |
| Fatty alcohol ethoxylate | 2 | | | 1 |
| Glucoside | | 0.5 | | |
| Builders | | | | |
| Sulphate | | | 5.7 | 5 |
| Excipients | | | | |
| PEG | 2 | | 3 | 2.5 |
| Stearate | 0.5 | 0.2 | 0.1 | |
| Cellulose | | | 1.5 | |
| Pyrogenic silica | 0.2 | 0.3 | 0.2 | 0.5 |
| Total | 100 | 100 | 100 | 100 |

The powdery cleaning agent prepared according to this recipe is then pressed as press material as described above into a cleaning agent molded article. For recipe 1, the average grain size lies in the range of 500 μm and 1000 μm, wherein more than 95% of the particles have a particle size in the range of 200 μm to 1600 μm. For recipe 2, an average grain size in the range of 500 μm and 1000 μm is selected, wherein more than 90% of the particles have a particle size in the range of 200 μm to 1600 μm. For recipes 3 and 4, an average grain size in the range of 200 μm and 500 μm is selected, wherein more than 75% of the particles have a particle size in the range of 200 μm to 1600 μm.

In the case of these sample recipes, the cleaning agent molded article can preferably have the following dimensions:

diameter d: approx. 28 mm length $l_Z$ of the cylinder portion: approx. 35 mm total length $l_G$: approx. 45 mm length a of the grooves: approx. 25 mm width b of the grooves: approx. 2 mm depth t of the grooves: approx. 8 mm The total quantity of the cleaning agent is then approx. 35 g.

TABLE 2

| recipe examples for a rinsing agent molded article | | |
|---|---|---|
| Components rinsing agent molded article (% by weight) | Recipe 1 | Recipe 2 |
| Acid system | | |
| Citric acid | 40 | 45 |
| Malic acid | | 40 |
| Adipic acid | | 10 |
| Complexing agent | | |
| Polymer | | 1.5 |
| Surfactants | | |
| Fatty alcohol ethoxylate | 2 | 0.5 |
| Builders | | |
| Sulphate | 50 | |
| Excipients | | |
| PEG | 7 | 3 |
| Pyrogenic silica | 1 | |
| Total | 100 | 100 |

The powdery rinsing agent prepared according to this recipe is then pressed as pressed material into a rinsing agent molded article. For recipe 1, the average grain size lies in the range of 200 μm and 500 μm in this case, wherein more than 50% of the particles have a particle size in the range of 200 μm to 1600 μm. For recipe 2, an average grain size in the range of 200 μm and 500 μm is selected, wherein more than 75% of the particles have a particle size in the range of 200 μm to 1600 μm.

In summary, it is pointed out once again that the cleaning and/or rinsing agent molded articles, cleaning products as well as methods and devices described above in detail, are only exemplary embodiments, which can be modified in a variety of ways by the person of skill in the art, without leaving the scope of the invention. It would in particular be possible to guide the lateral bars in the die all the way to the top, provided that the mechanism of the tableting machine is designed so that the upper punch can be guided sufficiently exactly. In this case, the grooves in the cleaning and/or rinsing agent molded article would then run accordingly to the upper edge. A similar method for pressing can be used as well, as it is illustrated above, in order to introduce dome-shaped or similar end face portions on both end faces, i.e. on the bottom and on the top. Only the punch shape of the lower punch tool needs to then be formed accordingly. The lower punch tool could then additionally include a type of ejection piston, which additionally pushes the completely pressed cleaning and/or rinsing agent molded article to the top, so that the latter can be displaced sideways, without the end face portion being sheared off. It would likewise also be possible to only provide one such end face portion on the bottom in the mold on the cleaning and/or rinsing agent molded article and to design the upper punch so that a flat end face is created on this side. This can have advantages for the ventilation, but does in turn require an additional ejection piston in the lower punch or other additional effort for removing the cleaning and/or rinsing agent molded article from the press. The use of the indefinite article "one" furthermore does not rule out that the relevant features can also be present several times. The term "unit" likewise does not rule out that the latter also consists of a plurality of sub-units, which may be spatially separated.

REFERENCE LIST

1, 1', 1" cleaning and/or rinsing agent molded article
2 roll surface/cylinder jacket surface
3 end face
4 end face
5 end face portion
7 groove
8 cylinder portion
9 chamber
10 cleaning product
11 pouch
12 tear notch
13 predetermined breaking seam
20 mold
21 press chamber/die
22 interior
23 bar
25 lower punch
26 punch shape
27 grooves
28 upper punch
29 punch shape
30 rotor
31 supply unit
32 wiper mechanism
100 cooking appliance
101 cooking chamber
102 bottom
103 outlet nozzle
104 inlet openings/nozzles
105 line system
106 trace heating
107 recirculation container/storage tank
108 pump
109 fresh water supply
110 pump
111 outlet valve
112 outlet line
113 outlet valve
114 outlet line
A longitudinal axis/axis of rotation
a length of the groove
b width of the groove 7
d diameter
$l_G$ total length
$l_Z$ length of the cylinder portion
P press material
$R_1$, $R_2$, $R_3$, $R_4$, $R_5$ direction
t depth of the groove 7

The invention claimed is:

1. A cleaning and/or rinsing agent molded article, comprising:

a cylindrical roll surface which is formed as a roller that is substantially cylindrical; and two end faces connected by the roll surface, wherein the cleaning and/or rinsing agent molded article has, on at least one of the two end faces, an end face portion, which is shaped so that the cleaning and/or rinsing agent molded article falls sideways onto the roll surface when the cleaning and/or rinsing agent molded article meets or is placed on a solid surface with the at least one end face, and the cylindrical roll surface has a length, in a length direction of the molded article, that is greater than a height, in the length direction of the molded article from an end of the cylindrical roll surface, of the at least one end surface.

2. The cleaning and/or rinsing agent molded article according to claim 1, wherein the end face portion is formed in a substantially dome-shaped or conical manner.

3. A cleaning and/or rinsing agent molded article, comprising:

a roll surface which is formed as a roller that is substantially cylindrical; and two end faces connected by the roll surface, wherein the cleaning and/or rinsing agent molded article has, on at least one of the two end faces, an end face portion, which is shaped so that the cleaning and/or rinsing agent molded article falls sideways onto the roll surface when the cleaning and/or rinsing agent molded article meets or is placed on a solid surface with the at least one end face, which, in its surface at least in the roll surface, has a plurality of cavities or grooves.

4. The cleaning and/or rinsing agent molded article according to claim 3, wherein of the plurality of cavities or groves, at least one of the grooves runs in the longitudinal direction of the roll surface from at least one of the two end faces that is formed across a partial portion of the roll surface.

5. The cleaning and/or rinsing agent molded article according to claim 1, wherein the at least one end face portion is 40% or less of the total length of the cleaning and/or rinsing agent molded article.

6. A cleaning and/or rinsing agent molded article, comprising:

a roll surface which is formed as a roller that is substantially cylindrical; and two end faces connected by the roll surface, wherein the cleaning and/or rinsing agent molded article has, on at least one of the two end faces, an end face portion, which is shaped so that the cleaning and/or rinsing agent molded article falls sideways onto the roll surface when the cleaning and/or rinsing agent molded article meets or is placed on a solid surface with the at least one end face, wherein a density of the cleaning and/or rinsing agent molded article along a longitudinal axis of the cleaning and/or rinsing agent molded article varies, and the density of the cleaning and/or rinsing agent molded article is higher in a region, which is spaced apart from the end face portion, than at the end face portion.

7. The cleaning and/or rinsing agent molded article according to claim 1, which is formed as a cleaning agent molded article and contains a highly alkaline solid cleaning agent comprising an anionic and/or non-ionic surfactant.

* * * * *